US010494754B2

(12) United States Patent
Cho et al.

(10) Patent No.: US 10,494,754 B2
(45) Date of Patent: Dec. 3, 2019

(54) CLOTHES DRYER

(71) Applicant: LG Electronics Inc., Seoul (KR)

(72) Inventors: Hongjun Cho, Seoul (KR); Jinwoo Bae, Seoul (KR); Sanghun Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 699 days.

(21) Appl. No.: 14/333,167

(22) Filed: Jul. 16, 2014

(65) Prior Publication Data

US 2015/0020402 A1 Jan. 22, 2015

(30) Foreign Application Priority Data

Jul. 16, 2013 (KR) ..... 10-2013-0083685
Apr. 28, 2014 (KR) ..... 10-2014-0051051
Jun. 19, 2014 (KR) ..... 10-2014-0075040

(51) Int. Cl.
*D06F 58/02* (2006.01)
*D06F 58/20* (2006.01)
*D06F 58/26* (2006.01)

(52) U.S. Cl.
CPC ..... *D06F 58/02* (2013.01); *D06F 58/20* (2013.01); *D06F 58/26* (2013.01); *D06F 58/263* (2013.01)

(58) Field of Classification Search
CPC ..... D06F 58/02; D06F 58/20; D06F 58/26; D06F 58/263; D06F 58/10; F26B 23/00; F26B 23/001; F26B 23/002; F26B 23/007
USPC ..... 431/195, 196, 197, 198, 199, 200, 201; 392/492, 493
See application file for complete search history.

(56) References Cited

U.S. PATENT DOCUMENTS 2,158,602 A 5/1939 Calhoun
2,527,013 A 10/1950 Kjelgaard
3,995,988 A * 12/1976 Freze ..... D06F 58/263 34/607
4,485,566 A 12/1984 Vivares
(Continued)

FOREIGN PATENT DOCUMENTS

CN 1873086 A 12/2006
CN 1886628 A 12/2006
(Continued)

*Primary Examiner* — Jianying C Atkisson
*Assistant Examiner* — Tavia Sullens
(74) *Attorney, Agent, or Firm* — Birch, Stewart, Kolasch & Birch, LLP

(57) ABSTRACT

A clothes dryer capable of minimizing heat energy loss and increasing energy efficiency includes a cabinet, a drum provided within the cabinet, an exhaust duct through which air discharged from the drum is discharged out of the cabinet, an intake duct through which air is guided to the drum, a heating portion which heats air introduced into the intake duct, a heat exchanger provided within the exhaust duct and having a first heat exchange space in which air discharged from the drum exchanges heat with air introduced from the inside or outside of the cabinet into the exhaust duct, and a preheating member including a second heat exchange space through which air passing through the heat exchanger is guided to the intake duct so that air flowing into the intake duct via the heat exchanger exchanges heat with heat radiated from the intake duct in the second heat exchange space.

8 Claims, 14 Drawing Sheets

(56) References Cited

U.S. PATENT DOCUMENTS

| | | | | |
|---|---|---|---|---|
| 4,621,438 | A | 11/1986 | Lanciaux | |
| 2006/0034593 | A1* | 2/2006 | Rapoza | D06F 58/26 392/350 |
| 2006/0156767 | A1 | 7/2006 | Kim et al. | |
| 2008/0110044 | A1 | 5/2008 | Ehlers | |
| 2010/0132216 | A1 | 6/2010 | Krausch et al. | |
| 2011/0041352 | A1 | 2/2011 | Hong et al. | |
| 2012/0017456 | A1 | 1/2012 | Grunert | |
| 2012/0030960 | A1 | 2/2012 | Ryoo et al. | |

FOREIGN PATENT DOCUMENTS

| | | | |
|---|---|---|---|
| CN | 101387068 | A | 3/2009 |
| CN | 101995147 | A | 3/2011 |
| CN | 102505437 | A | 6/2012 |
| EP | 2 778 281 | A1 | 9/2014 |
| KR | 10-2006-0007470 | A | 1/2006 |
| KR | 10-2006-0065872 | A | 6/2006 |
| KR | 10-2009-0026563 | A | 3/2009 |
| KR | 10-2009-0116108 | A | 11/2009 |
| KR | 10-2011-0020430 | A | 3/2011 |
| KR | 10-2011-0097125 | A | 8/2011 |
| KR | 10-1074701 | B1 | 10/2011 |
| WO | WO 2013/067837 | A1 | 5/2013 |

* cited by examiner

CLOTHES DRYER

CROSS-REFERENCE TO RELATED APPLICATIONS

Pursuant to 35 U.S.C. § 119(a), this application claims the benefit of Korean Patent Application No. 10-2013-0083685, filed on Jul. 16, 2013, Korean Patent Application No. 10-2014-0051051, filed Apr. 28, 2014, and Korean Patent Application No. 10-2014-0075040, filed on Jun. 19, 2014, which are hereby incorporated by reference as if fully set forth herein.

BACKGROUND OF THE INVENTION

Field of the Invention

The present invention relates to a clothes dryer.

Discussion of the Related Art

In general, a clothes dryer is an apparatus in which laundry after completion of washing and dehydration processes is inserted into a drum (or a tub) of the dryer so as to evaporate moisture from the laundry and dry the same by supplying hot air into the drum.

The dryer includes a drum into which laundry is inserted in the dryer, a driving motor for driving the drum, an air blowing fan for blowing air into the drum, and a heating unit for heating air introduced into the drum.

A combustion type heater using fuel such as liquefied gas, an electric heat type heater using electric resistance, or the like is used as the heating unit.

In this case, only a portion of heat generated by the heater is used to generate hot air, and the remaining heat is discharged out of an intake duct without being used for a clothes drying process, thereby causing a heat loss.

Meanwhile, the air, which evaporates moisture from laundry in the drum of the clothes dryer and is then emitted therefrom, has the moisture of the laundry inside the drum and is hot and humid air.

The dryer may be classified into a condensation type dryer and an exhaust type dryer to be described later according to a method of processing hot and humid air.

The condensation type dryer is a dryer configured such that hot and humid air, which dries an object to be dried within a drum, is dehumidified through a condenser and is then heated to be supplied again into the drum.

That is, the condensation type dryer reuses heat energy in such a manner that hot air, which is hot and humid by exchange of the hot air with laundry in the drum, is circulated without being discharged out of the dryer.

The exhaust type dryer is a dryer configured such that air, which is hot and humid by heating external air, is supplied into a drum so as to be used to dry an object to be dried within the drum, and is then discharged to the outside.

In this case, since hot and humid air discharged from the drum of the dryer is intactly discharged out of a cabinet through an exhaust duct, there is a problem in that the hot air is not reused and thus causes a heat loss.

The heat loss in the exhaust type dryer may be classified into a heat loss caused in the process of moving hot air generated during passing through a heater into the drum, a heat loss caused in the process of drying clothes within the drum into which hot air is introduced, and a heat loss due to hot air discharged out of the cabinet.

Accordingly, there is a need for a heat recovery system capable of increasing energy efficiency by recovering heat energy lost in the exhaust type dryer.

SUMMARY OF THE INVENTION

The present invention has been made in view of the above problems, and an object thereof is to provide a clothes dryer capable of minimizing a heat energy loss of an exhaust type dryer.

Another object of the present invention is to provide a clothes dryer capable of minimizing flow resistance of air introduced for generation of hot air.

A further object of the present invention is to provide a clothes dryer capable of increasing energy efficiency.

To achieve these objects and other advantages and in accordance with an aspect of the present invention, a clothes dryer includes a cabinet, a drum provided within the cabinet to provide a space for receiving laundry, and an intake duct forming a passage through which air introduced through an air inlet is supplied to the drum.

In addition, the clothes dryer includes an exhaust duct forming a passage through which air is discharged from the drum, and a preheating member having a heat exchange space in which air introduced into the intake duct exchanges heat with heat radiated from the intake duct for preheating the air.

The preheating member may include a preheating portion formed to surround the intake duct in order to form the heat exchange space, and the preheating portion is formed with at least one air introduction hole.

In addition, the preheating member may be spaced apart from the air inlet in the front thereof by a predetermined distance, and include a flow switching portion which guides air passing through the preheating portion to the air inlet.

Meanwhile, one side of the air introduction hole may be provided with an air guide for guiding air to the air introduction hole, and the air guide may be formed in a circular arc shape opened upward of the air introduction hole such that one side of the air guide is fixed adjacent to the air introduction hole and the other side thereof has a certain angle.

In addition, a drum adjacent portion installed adjacent to an outer peripheral surface of the drum in the preheating portion may be spaced apart from the drum by a minimum distance so as not to interfere with rotation of the drum, and is curved so as to have the same radius of curvature as the outer peripheral surface of the drum.

To achieve these objects and other advantages and in accordance with another aspect of the present invention, a clothes dryer includes a cabinet, a drum provided within the cabinet to provide a space for receiving laundry, and an intake duct forming a passage through which air introduced through an air inlet is supplied to the drum.

In addition, the clothes dryer includes a heating portion provided in the intake duct so as to heat air introduced into the intake duct, an exhaust duct forming a passage through which air is discharged from the drum, and a preheating member having a heat exchange space in which air introduced into the intake duct exchanges heat with heat radiated from the intake duct for preheating the air.

To achieve these objects and other advantages and in accordance with a further aspect of the present invention, a clothes dryer includes a cabinet, a drum provided within the cabinet to provide a space for receiving laundry, and an intake duct forming a passage through which air introduced through an air inlet is supplied to the drum.

In addition, the clothes dryer may include a heating portion which heats air introduced into the intake duct and an exhaust duct forming a passage through which air is discharged from the drum.

The cabinet may be formed therein with an exhaust passage through which air discharged from the drum is discharged out of the cabinet through the exhaust duct, and an intake passage through which air inside or outside the cabinet is guided to the drum.

In addition, the exhaust passage may be provided with a heat exchanger in which air discharged to the exhaust passage exchanges heat with air introduced into the intake passage.

The clothes dryer may further include a preheating member formed with a heat exchange space through which air passing through the heat exchanger is guided to the intake duct so that air flowing into the intake duct via the heat exchanger exchanges heat with heat radiated from the intake duct in the heat exchange space.

To achieve these objects and other advantages and in accordance with a further aspect of the present invention, a clothes dryer includes a cabinet, a drum provided within the cabinet to provide a space for receiving laundry, an intake duct through which hot air is supplied to the drum, and a heating portion provided in the intake duct so as to heat air introduced into the intake duct.

In addition, the clothes dryer includes an exhaust duct through which air is discharged from the drum, and a heat exchanger which is provided inside the exhaust duct, and is formed therein with a divided space in which air introduced from the inside or outside of the cabinet and air discharged from the drum respectively flow in a first flow direction and a second flow direction so that heat exchange is performed while the air flows in the first and second flow directions.

In this case, the first and second flow directions of air flowing within the heat exchanger are perpendicular to each other.

The preheating member may be fixed to an upper side of the exhaust duct, to guide air passing through the heat exchanger to the intake duct.

Meanwhile, an air introduction port may be provided on a lower surface of the exhaust duct so as to face a bottom opening portion formed on a bottom of the cabinet, air being introduced from the bottom opening portion through the air introduction port, and an air discharge port, through which air passing though the heat exchanger is discharged, may be provided on an upper surface of the exhaust duct spaced apart from the lower surface of the exhaust duct in a height direction thereof by a predetermined distance.

In this case, the bottom of the cabinet may be formed with an opening portion through which air outside the cabinet is capable of being introduced into the cabinet.

Accordingly, the first flow direction may be a flow direction in which air introduced into the air introduction port is discharged to the air discharge port.

The clothes dryer may further include a preheating member formed with a heat exchange space through which air passing through the heat exchanger is guided to the intake duct so that air flowing into the intake duct via the heat exchanger exchanges heat with heat radiated from the intake duct in the heat exchange space.

Accordingly, after air flowing in the first flow direction primarily exchanges heat with air flowing in the second flow direction while passing through the heat exchanger, the air may be preheated by secondarily exchanging heat with heat radiated from the intake duct while flowing into the intake duct.

In the clothes dryer according to a further aspect of the present invention, the exhaust duct may further include a heat exchanger provided therein, and may be formed with a first heat exchange space in which air discharged from the drum exchanges heat with air introduced from the inside or outside of the cabinet into the exhaust duct.

In addition, the preheating member may be formed with a second heat exchange space through which air passing through the heat exchanger is guided to the intake duct, so that air introduced into the intake duct via the heat exchanger exchanges heat with heat radiated from the intake duct in the second heat exchange space.

Thus, air introduced from the inside or outside of the cabinet may be primarily preheated while flowing in the first heat exchange space and then be secondarily preheated while flowing in the second heat exchange space, so as to be introduced into the intake duct.

In addition, a first flow direction of air flowing toward the intake duct from the bottom of the cabinet and a second flow direction of air discharged from the drum may be defined in the heat exchanger. The first and second flow directions may be defined to intersect with each other by a predetermined angle.

The preheating member may include a preheating portion formed to surround the intake duct in order to form the heat exchange space, and a flow switching portion for guiding air passing through the preheating portion to an air inlet formed on one side end of the intake duct.

The preheating portion may have one or more air introduction holes through which air is introduced.

The preheating member may further include a drum adjacent portion provided adjacent to an outer peripheral surface of the drum in at least one surface of the preheating member formed with the one or more air introduction holes.

In addition, the preheating member may be formed with a first intake passage through which air is introduced into the intake duct via the heat exchanger and a second intake passage through which air is introduced into the intake duct through the air introduction holes.

A clothes dryer according to an embodiment of the present invention is to solve the above problems of the related art, and may minimize a heat energy loss by preheating air introduced into an intake duct by means of using heat lost in the process of generating hot air for drying clothes or in the process of drying clothes in a drum.

The clothes dryer according to the embodiment of the present invention may recover heat lost in the process of generating and discharging hot air to convert the heat into energy which preheats air introduced for generation of hot air, thereby enabling energy efficiency to be increased.

Since the clothes dryer according to the embodiment of the present invention minimizes flow resistance of air introduced into an intake duct of the clothes dryer and enlarges a contact area with air by a heater composed of surface heating elements, it may be possible to increase efficiency for generation of hot air.

In a clothes dryer according to another embodiment of the present invention, since air for generation of hot air is directly introduced through a bottom of a cabinet, it may be possible to minimize resistance of air introduced into an intake duct for generation of hot air.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

DETAILED DESCRIPTION OF THE INVENTION

Figure 1:
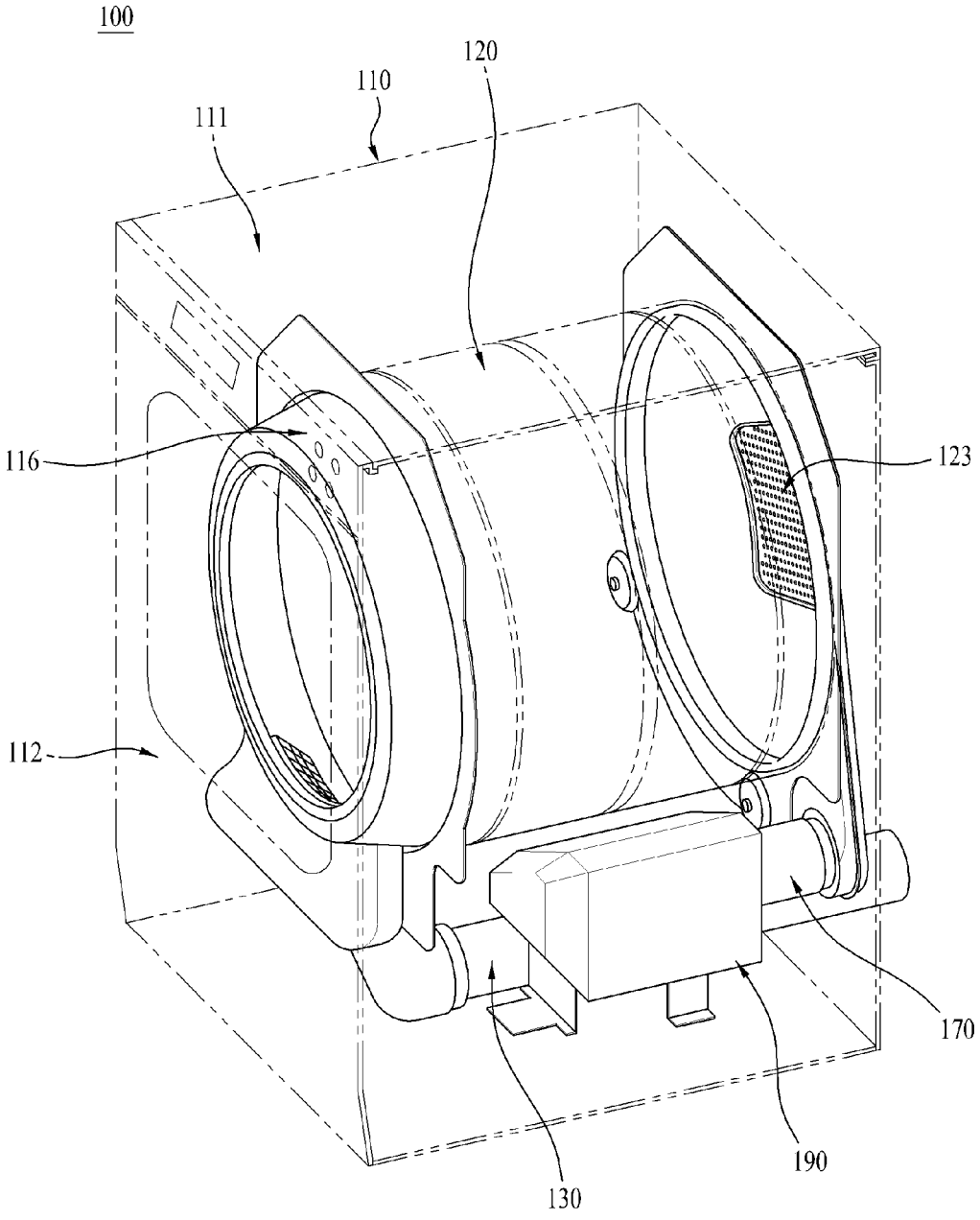
FIG. 1 is a perspective view illustrating a clothes dryer according to an embodiment of the present invention.

Reference will now be made in detail to a clothes dryer according to embodiments of the present invention, examples of which are illustrated in the accompanying drawings. These drawings are only presented for detailed description of the present invention and the spirit and scope of the present invention are not limited thereto.

In addition, the same reference numbers will be used throughout the drawings to refer to the same or like parts, and the duplicated description thereof will be omitted. In the drawings, the size or shape of each component may be exaggerated or reduced for convenience of description and clarity.

Meanwhile, the terms including expressions, such as first and/or second, used in the specification of the present invention may be used to describe various elements of the present invention. However, the elements of the present invention should not be limited by the terms used in the specification of the present invention. That is, such terms will be used only to differentiate one element from other elements of the present invention.

Hereinafter, each component of a clothes dryer according to an embodiment of the present invention will be described in detail with reference to the accompanying drawings.

Figure 2:
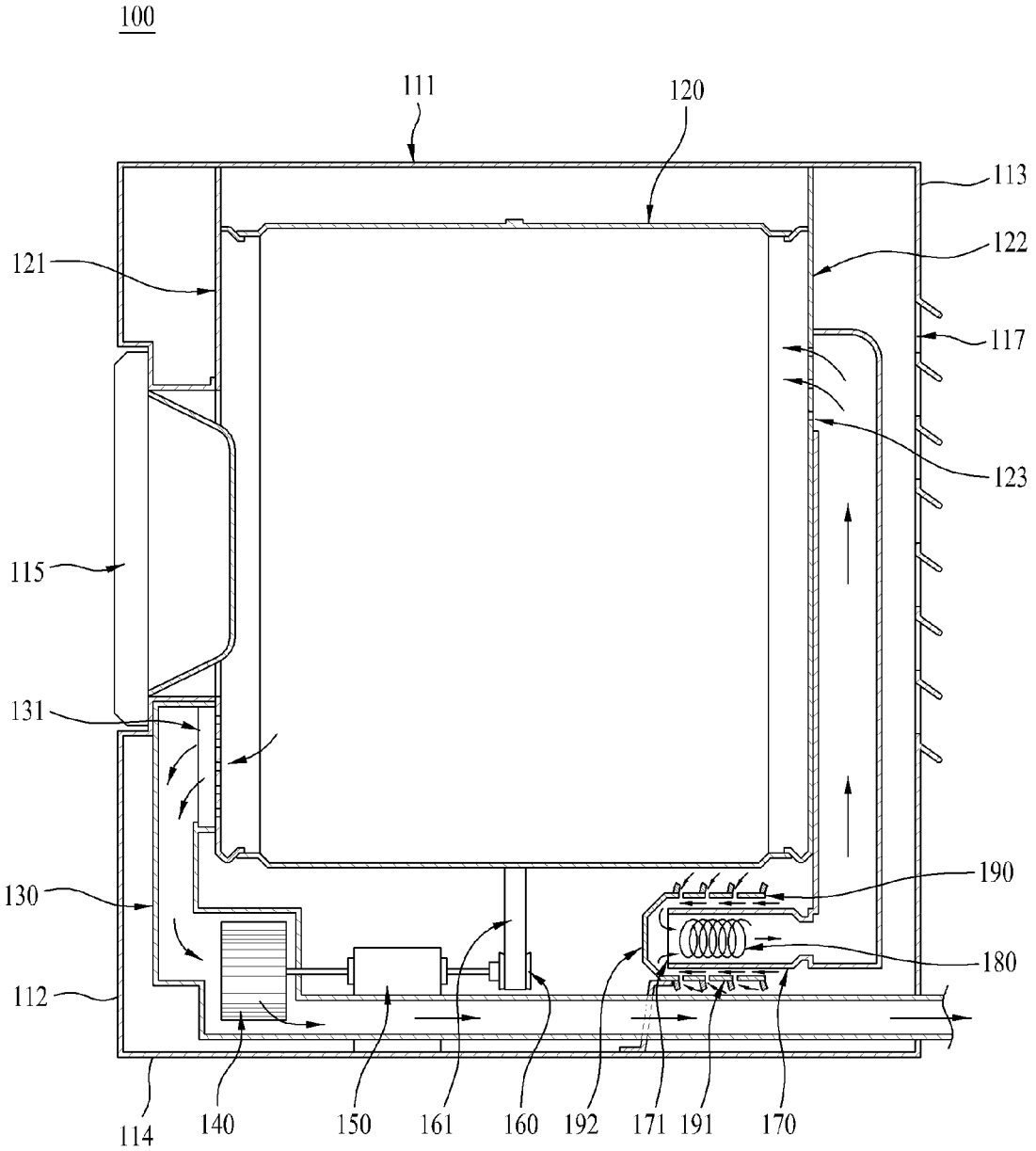
FIG. 2 is a side cross-sectional view illustrating the clothes dryer according to the embodiment of the present invention.

FIG. 1 is a perspective view illustrating a clothes dryer according to an embodiment of the present invention. FIG. 2 is a side cross-sectional view illustrating the clothes dryer of FIG. 1.

A clothes dryer 100 according to an embodiment of the present invention includes a cabinet 110 including a front cover 112, side covers (not shown), a rear cover 113, and a top cover 111 which define an external appearance thereof, and a base 114 forming a bottom thereof, and a drum 120 installed within the cabinet 110.

The rear cover 113 forming a rear surface of the cabinet 110 may be formed with an opening portion 117 through which air may be introduced into the cabinet 110.

The drum 120 is rotatably installed within the cabinet 110 and receives laundry to be dried.

In addition, the clothes dryer 100 may include a door 115 which is mounted to the front cover 112 to open and close an opening portion of the drum 120, and a control panel 116 which is provided on the front cover 112 and has a variety of buttons for input of drying conditions.

The drum 120 may have a hollow cylindrical shape opened at front and rear end portions thereof. The drum 120 is supported by a front support 121 installed at a front portion within the cabinet 110 and a rear support 122 installed at a rear portion within the cabinet 110 (see FIG. 2).

In this case, even when the drum 120 is rotated, the front and rear supports 121 and 122 are not rotated in a state of being fixed inside the cabinet 110. That is, although the front and rear supports 121 and 122 are stationary, the drum 120 is rotatably supported relative to the stationary supports.

The front support 121 is connected with an exhaust duct 130. One end of the exhaust duct 130 is connected to the front support 121 so as to communicate with the drum 120, and the other end thereof communicates with the outside of the cabinet 110.

A connection part between the front support 121 and the exhaust duct 130 may be additionally provided with a filter 131 which filters out air discharged from the drum 120 after drying.

The exhaust duct 130 is equipped with an air blowing fan 140. The air blowing fan 140 is directly connected to a motor 150 to discharge air in the drum 120 to the outside of the cabinet 110 through the exhaust duct 130.

Due to rotation of the air blowing fan 140, pressure in the drum 120 is lowered and air outside the cabinet 110 is naturally introduced into the cabinet through the rear opening portion 117 of the cabinet 110.

The motor 150 has two rotary shafts, one of which is connected with the air blowing fan 140 to drive the air blowing fan 140.

The other rotary shaft of the motor 150 is coupled to a pulley 160 connected to the drum 120 by a belt 161 to rotate the pulley 160 so that the drum 120 is rotated by rotation of the belt 161.

In this case, a motor for driving the air blowing fan 140 and a motor for rotating the drum 120 may also be separately provided.

Meanwhile, the rear support 122 is connected with an intake duct 170. One end of the intake duct 170 may be connected to the rear end portion of the drum 120 through a hot air supply port 123 formed on the rear support 122 so as to supply hot air to the drum 120.

The other end of the intake duct 170 may be provided with an air inlet 171 through which air is introduced for supplying hot air to the drum 120.

The intake duct 170 may be equipped, at an end thereof, with a heating portion 180 for heating air.

The heating portion 180 heats air introduced into the intake duct 170 to supply the heated air to the drum 120. In this case, the heating portion 180 is preferably installed adjacent to the air inlet 171 for introduction of air into the intake duct 170.

The heating portion 180 may also be composed of a resistance coil heater which uses electrical resistance heat or a burner which generates heat by combustion of gas.

Meanwhile, a preheating member (preheater) 190 for preheating air introduced into the intake duct 170 may be installed in the front of the air inlet 171.

The heating portion 180 generates heat equal to or greater than a predetermined temperature for heating of introduced air, and the heat is transferred to air flowing around the heating portion 180 by a conduction or convection phenomenon. In this case, the heat transferred to air surrounding the heating portion 180 is radiated out of the intake duct 170 and generates hot air external to the intake duct 170, thereby enabling a heat energy loss to be caused.

Accordingly, there is a need for a structure in which heat lost by radiation out of the intake duct 170 is reused to increase energy efficiency.

In accordance with the embodiment of the present invention, to solve the above problem, there may be provided the preheating member 190 which is spaced apart from an outer peripheral surface of the intake duct 170 by a predetermined distance and surrounds the intake duct 170.

The preheating member 190 may form a space in which air flowing in the heating member 190 may be exchanged with heat radiated from the intake duct 170. Thus, it may be possible to enhance energy efficiency of the dryer by reusing heat radiated through the intake duct 170 and preheating air flowing in the preheating member 190.

Meanwhile, the preheating member 190 may include a preheating portion (side wall) 191 which is spaced apart from the intake duct 170 by a predetermined distance and surrounds the intake duct 170, and a flow switching portion (end wall) 192 which guides air passing through the preheating portion 191 to the air inlet 171 of the intake duct 170.

The preheating portion 191 may be shaped to surround the intake duct 170 in order to form a flow space in which air introduced into the preheating portion 191 may flow along the outer peripheral surface of the intake duct 170.

In this case, the preheating portion 191 may be formed with a heat exchange space in which heat exchange is performed by heat radiated from the intake duct 170. Air flowing in the preheating portion 191 may flow in the heat exchange space and heat lost out of the intake duct 170 may be recovered and preheated.

Figure 3:
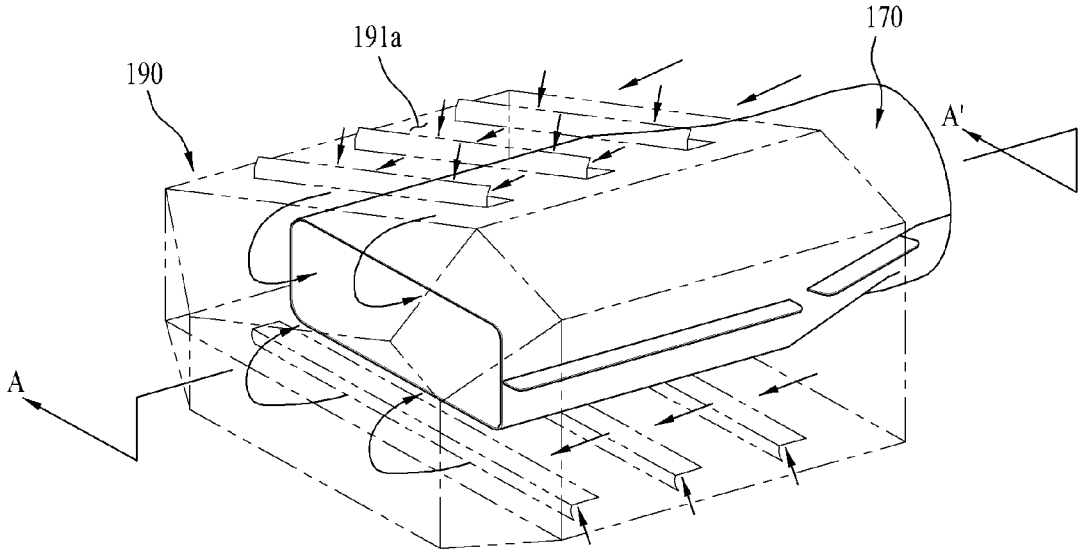
FIG. 3 is a perspective view illustrating a flow of air introduced into a preheating member and an intake duct according to the embodiment of the present invention.
Figure 4:
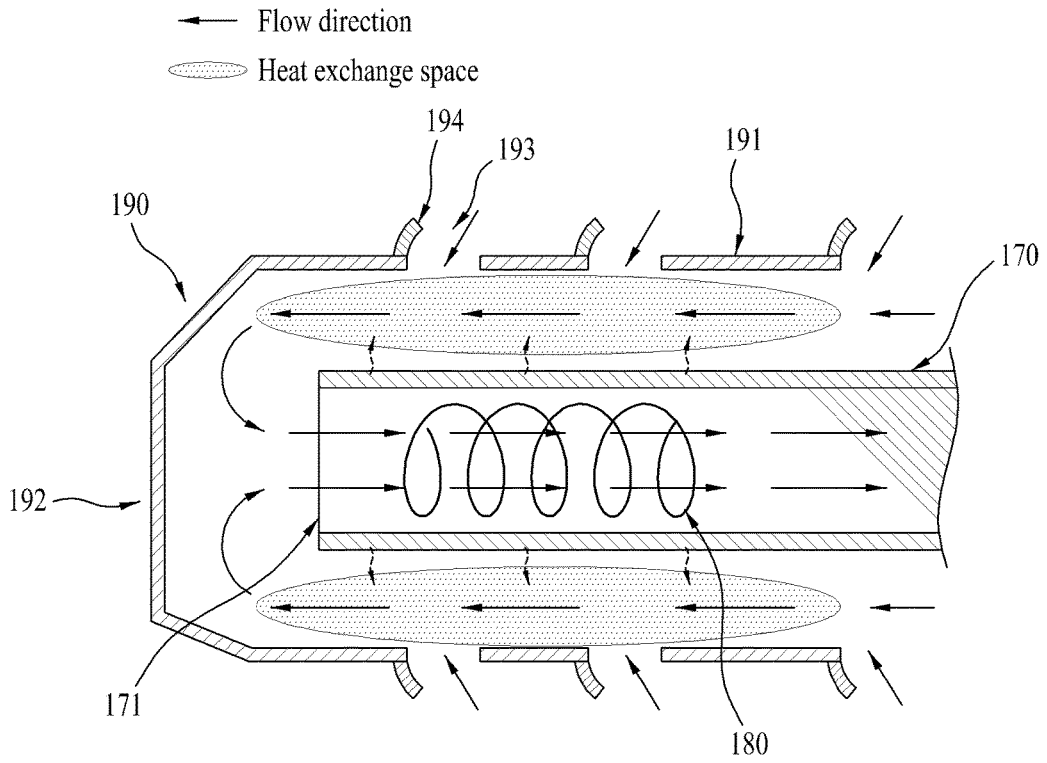
FIG. 4 is a cross-sectional view taken along line A-A' of FIG. 3.

Hereinafter, the preheating member 190 will be described in more detail with reference to FIGS. 3 and 4. FIGS. 3 and 4 are a perspective view and a cross-sectional view illustrating a flow of air introduced into the preheating member 190 and the intake duct 170 and show the arrangement of the preheating member 190 and the intake duct 170 and an air flow direction.

As shown in FIGS. 3 and 4, although the preheating portion 191 and flow switching portion 192 of the preheating member 190 are preferably formed integrally with each other, only the preheating portion 191 may be separately configured.

The preheating member 190 preferably has a hollow cylindrical shape opened at one side thereof. For example, the preheating member 190 may have a hollow cylindrical shape or a polyhedral shape, which is opened at one side thereof.

An opening portion formed in the air inlet 171 of the intake duct 170 and an opening portion of the preheating member 190 are preferably installed to be directed in a direction opposite to each other such that the preheating member 190 surrounds the intake duct 170.

Accordingly, an air flow space is formed in which air within the cabinet 110 is introduced into the preheating member 190 and then moves along the outer peripheral surface of the intake duct 170 to be introduced into the air inlet 171 of the intake duct 170.

As shown in the cross-sectional view of FIG. 4, the preheating portion 191 of the preheating member 190 is formed such that one side thereof extends to an installation position of the heating portion 180 of the intake duct 170.

This enables the heat exchange space, in which air passing through the preheating member 190 is preheated, to be effectively formed.

Meanwhile, the other side of the preheating portion 191 is connected to the flow switching portion 192. It is preferable that the flow switching portion 192 is spaced apart from the air inlet 171 in the front thereof by a predetermined distance to be formed in parallel with the air inlet 171.

In order to decrease flow resistance of air when the air flow direction is switched from the preheating portion 191 to the flow switching portion 192, a connection part at which the preheating portion 191 is connected to the flow switching portion 192 may be obliquely formed or be curved.

Meanwhile, at least one air introduction hole 193 provided in the preheating portion 191 of the preheating member 190 is formed in a direction parallel with or perpendicular to the flow direction of air flowing in the preheating portion 191.

Meanwhile, the at least one air introduction hole 193 provided in the preheating portion 191 of the preheating member 190 is preferably formed such that air within the cabinet 110 is more easily introduced into the preheating member 190.

The preheating portion 191 may be provided, at an outer surface thereof, with at least one air guide 194 for guiding air such that the air is easily introduced into the at least one air introduction hole 193.

This enables the flow resistance and flow loss of air introduced into the preheating member 190 to be reduced.

The air guide 194 may be formed in a circular arc shape opened upward of the air introduction hole 193 such that one side of the air guide 194 is fixed at a position adjacent to the air introduction hole 193 on the outer surface of the preheating portion 191 and the other side thereof has a certain angle.

In this case, the air guide 194 is preferably formed at each of the one or more air introduction holes 193.

In accordance with the above-mentioned configuration, air introduced into the plural air introduction holes 193 formed in the preheating member 190 is preheated while flowing in the heat exchange space for heat exchange with the intake duct 170, and is then introduced into the intake duct 170 by switching the flow direction of the air at the flow switching portion 192.

Figure 5:
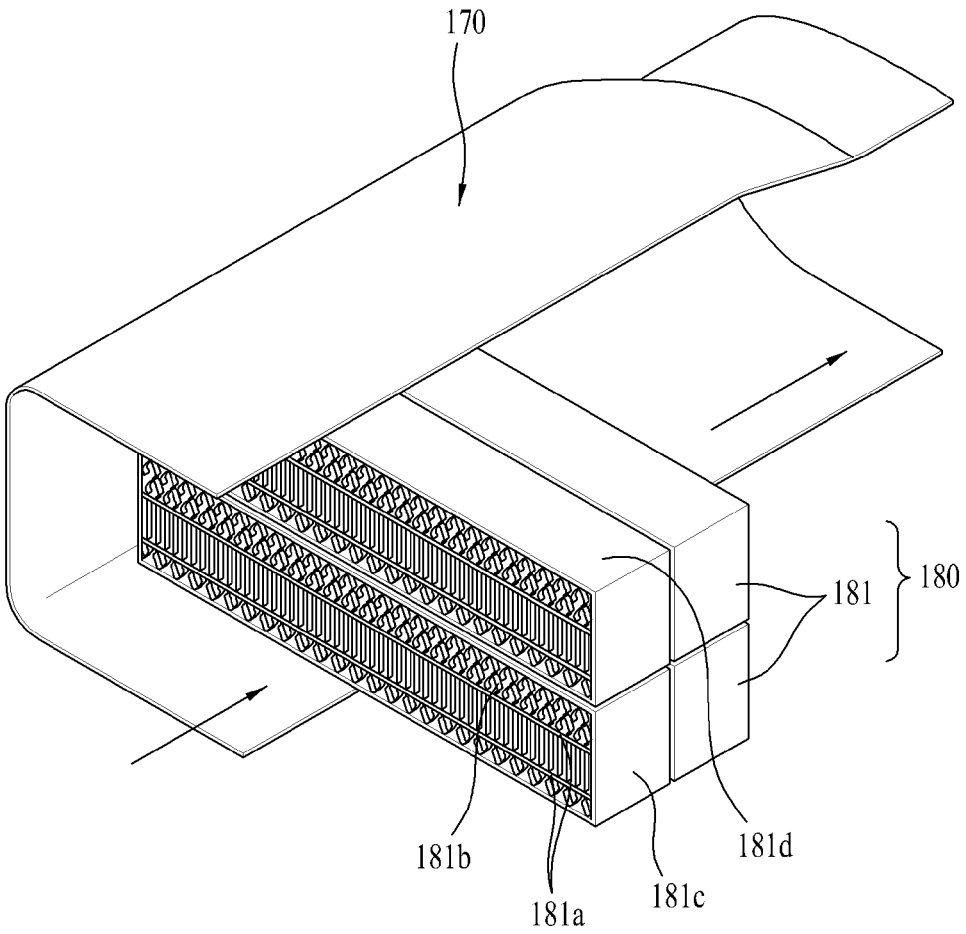
FIG. 5 is a perspective view illustrating a part to which a modified example of a heating portion according to the embodiment of the present invention is applied.

FIG. 5 is a perspective view illustrating a part to which a modified example of the heating portion 180 according to the preferable embodiment of the present invention is applied, wherein a heater 181 composed of surface heating elements 181*a* is shown as the modified example of the heating portion 180.

The heating portion 180 may also be composed of a resistance coil heater which uses electrical resistance heat or a burner which generates heat by combustion of gas.

Although the heater 181 composed of the surface heating elements 181*a* is described below as an example of the heating portion, the resistance coil heater or the burner may also be applied to the embodiment of the present invention, of course.

As shown in FIG. 5, one or more heaters 181 composed of the surface heating elements 181*a* are vertically or horizontally stacked so as to form one heating portion 180.

Each of the heaters 181 has a band shape in the form of a narrow width and a thin thickness and is manufactured as the surface heating elements 181*a*, each of which is formed by coating an insulation material on an outer surface of an amorphous metal alloy having flexibility.

The heater 181 is configured by one or more surface heating elements 181*a* for generating heat, radiation units 181*b* which easily radiate heat generated by the surface heating elements 181*a* to the outside, an electrode terminal portion 181*c* which applies electric current to the surface heating elements 181*a*, and a support plate 181*d* which supports the surface heating elements 181*a* and the radiation units 181*b*.

The one or more surface heating elements 181*a* are preferably stacked so as to be spaced apart from each other at regular intervals in a direction perpendicular to the flow direction of air introduced into the intake duct 170.

The radiation units 181*b* are fixed to upper and lower sides of the surface heating elements 181*a* by a fixing unit.

In this case, it is preferable that the radiation units 181*b* are continuously formed while having opening portions in a transverse direction of the surface heating elements 181*a*, in order to easily radiate heat generated by the surface heating elements 181*a* to the outside.

The electrode terminal portion 181*c* is formed in at least one side of left and right ends of the surface heating elements 181*a* in the transverse direction thereof, and is coupled to the surface heating elements 181*a* so as to apply electric current thereto.

The support plate 181*d* is installed to come into contact with the radiation units 181*b* formed at the upper and lower side ends of the surface heating elements 181*a* which are longitudinally stacked, and serves to support the surface heating elements 181*a* and the radiation units 181*b*.

The heater 181 manufactured as the surface heating elements 181*a* may reduce ventilation resistance and maximize an opening area because each heating element has a thin thickness.

In addition, each of the surface heating elements 181*a* is flexible due to having a narrow width and a thin thickness, and thus may be manufactured in a complicated shape.

Thus, since the heater 181 minimizes flow resistance of air introduced into the intake duct 170 and has a wide contact area with the introduced air, it may be possible to increase efficiency of hot air generation.

Figure 6:
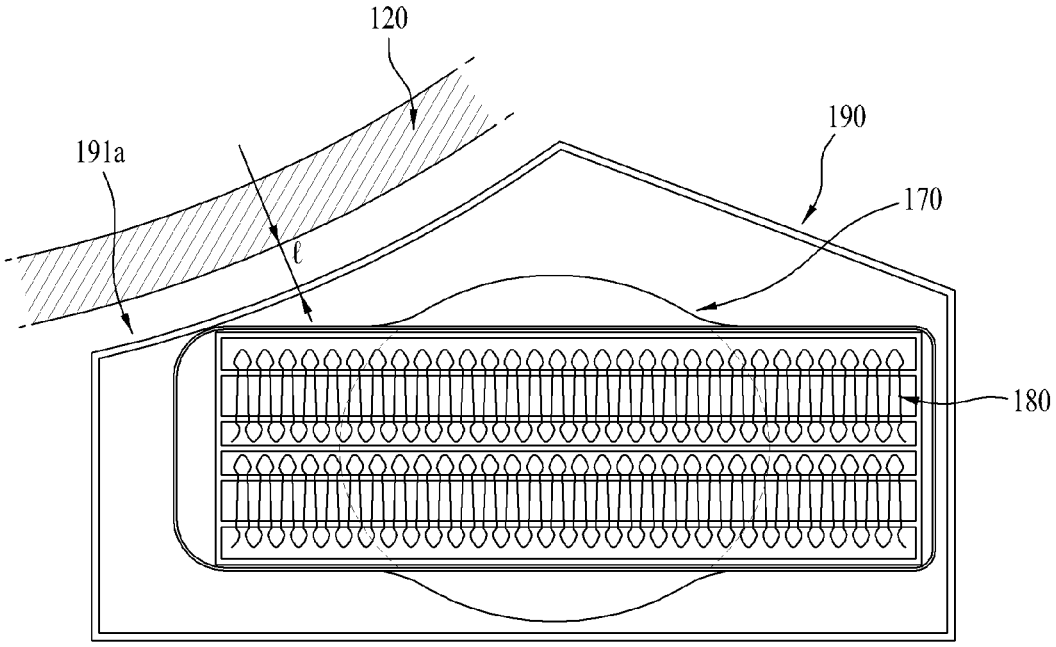
FIG. 6 is a cross-sectional view schematically illustrating a relationship between installation positions of an intake duct, a preheating member, and a drum to which a modified example of a heater according to the embodiment of the present invention is applied.

FIG. 6 is a cross-sectional view schematically illustrating a relationship between installation positions of an intake duct, a preheating member, and a drum to which a modified example of the heater according to the embodiment of the present invention is applied.

As a heat loss caused within the clothes dryer 100, there is a heat loss caused since heat energy is transferred from the outer peripheral surface of the drum 120 into the cabinet 110 in the drying process by supply of hot air.

Due to repetition of the drying process, air within the cabinet 110 has a high temperature by absorbing heat emitted from the drum 120.

Accordingly, at least one surface of the preheating member 190 is preferably provided with a drum adjacent portion 191*a* adjacent to the drum 120 such that air heated by heat emitted from the drum 120 is more easily introduced into the preheating portion 191.

In this case, the drum adjacent portion 191*a* of the preheating portion 191 is installed to be spaced apart from the drum 120 by a predetermined distance.

That is, the drum adjacent portion 191*a* is preferably spaced apart from the drum 120 by a minimum distance 1 so as not to interfere with rotation of the drum 120.

In addition, the drum adjacent portion 191*a* may be formed in parallel with the outer peripheral surface of the drum 120.

In this case, the drum adjacent portion 191*a* is curved so as to have the same radius of curvature as the drum.

Meanwhile, the intake duct 170 is located inside the preheating member 190 and the heating portion 180 is installed in the intake duct 170.

Accordingly, the intake duct 170 may also be changed in shape according to the shape of the heating portion 180 installed inside the intake duct 170.

As the modified example of the heater according to the preferable embodiment of the present invention, the intake duct 170, which is designed to be equipped with the heating portion 180 which is formed to be longer in a longitudinal direction than in a transverse direction, may interfere with the preheating member 190.

However, the clothes dryer of the present invention generally has a limited inner space.

Accordingly, since the clothes dryer has space restraints in a case of installing the above-mentioned various components, there is a limit in increasing the size of the intake duct 170 or preheating member 190.

Therefore, it is preferable that fillet is carried out on a corner of the intake duct 170 located adjacent to the drum 120 such that the corner has a large radius of curvature, so as not to generate interference even when a surface adjacent to the drum 120 among a plurality of surfaces of the preheating member 190 has a predetermined angle, as shown in FIG. 6.

Accordingly, the fillet is carried out on one side corner of the intake duct 170 such that the corner has a large radius of curvature, so that the intake duct 170 may be designed to be asymmetrical in left and right sides.

In this case, since one side of the heating portion 180 is spaced apart from the corner of the intake duct 170, on which the fillet is carried out such that the corner has a large radius of curvature, the heating portion 180 in the intake duct 170 may be installed to be asymmetrical.

An operation process of the clothes dryer according to the embodiment of the present invention will be schematically described again with reference to FIGS. 2 and 3.

In the process of drying laundry according to the present invention, the preheating portion 191 of the preheating member 190 is provided with one or more air introduction holes 193 so as to reduce a flow loss of air introduced into the preheating member 190, and air within the cabinet 110 is introduced through the air introduction holes 193.

Air passing through the preheating portion 191 is introduced into the air inlet 171 of the intake duct 170 by the flow switching portion 192 and is hot air having a high temperature while passing through the heating portion 180 installed in the intake duct 170, so that the hot air is supplied to the drum 120.

In this case, the drum 120 is rotated by driving of the motor 150, and an object to be dried comes into contact with the supplied hot air while being repeatedly tumbled in the drum 120, so as to be dried.

Humid air within the drum 120 is discharged out of the cabinet 110 through the exhaust duct 130 by the air blowing fan 140.

For this reason, an air circulation process is repeated in which air within the cabinet 110 is reintroduced into the preheating member 190 and air outside the cabinet 110 is introduced into the cabinet 110, so that drying is performed.

In this case, due to repetition of the drying process, air within the cabinet 110 has a high temperature by absorbing heat emitted from the drum 120.

The air which is hot is introduced into the one or more air introduction holes 193 of the preheating member 190.

The hot air introduced through the one or more air introduction holes 193 is in a sufficiently preheated state by additionally absorbing heat energy which is transferred from the heating portion 180 installed in the intake duct 170 to the outer surface of the intake duct 170.

The preheated air is introduced into the intake duct 170 and is hot air having a high temperature while passing through the heating portion 180, so that the hot air is supplied to the drum 120.

Hereinafter, a clothes dryer according to another embodiment of the present invention will be described with reference to FIGS. 7 and 8.

Figure 7:
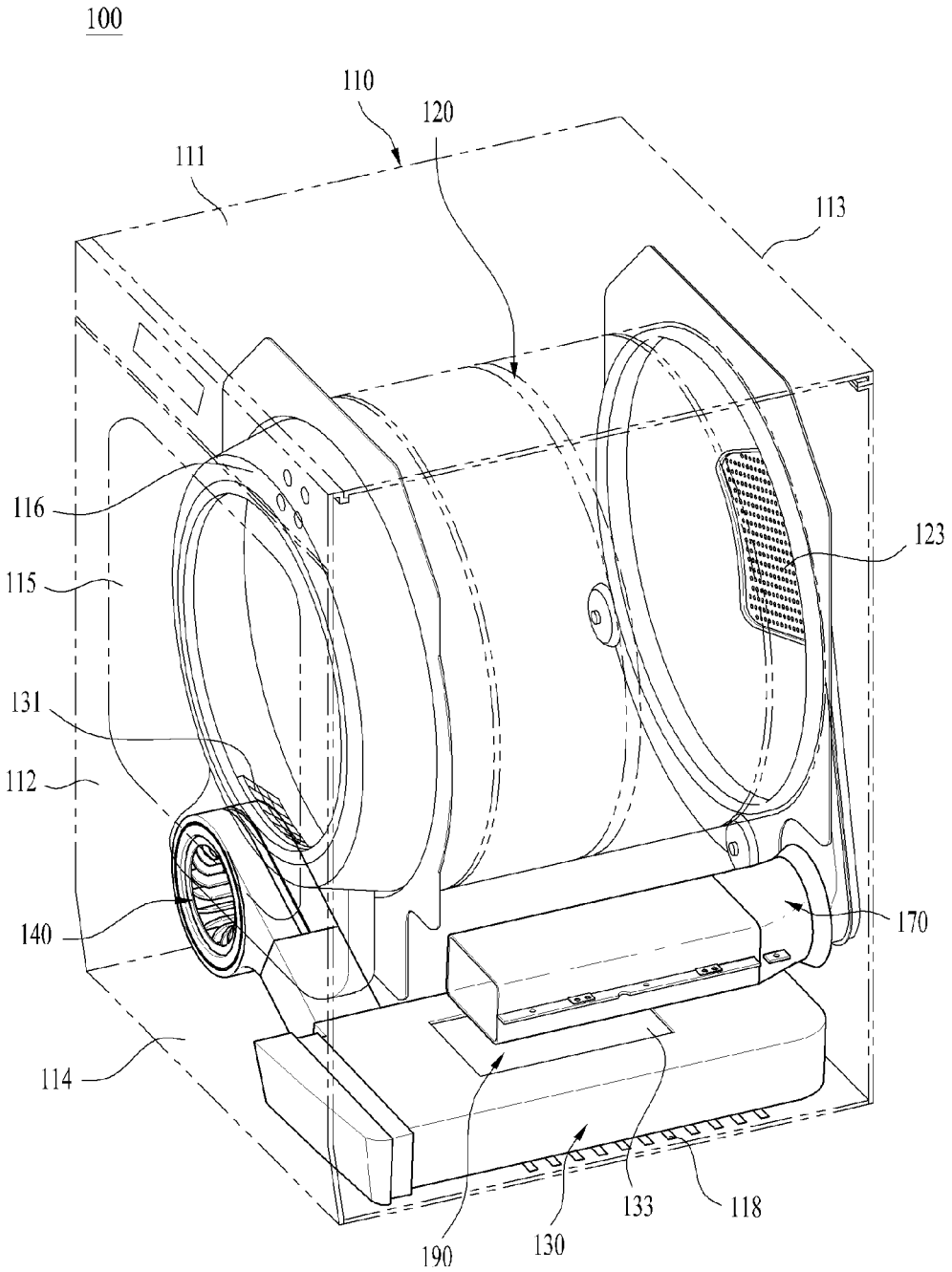
FIG. 7 is a perspective view illustrating a clothes dryer according to another embodiment of the present invention.
Figure 8:
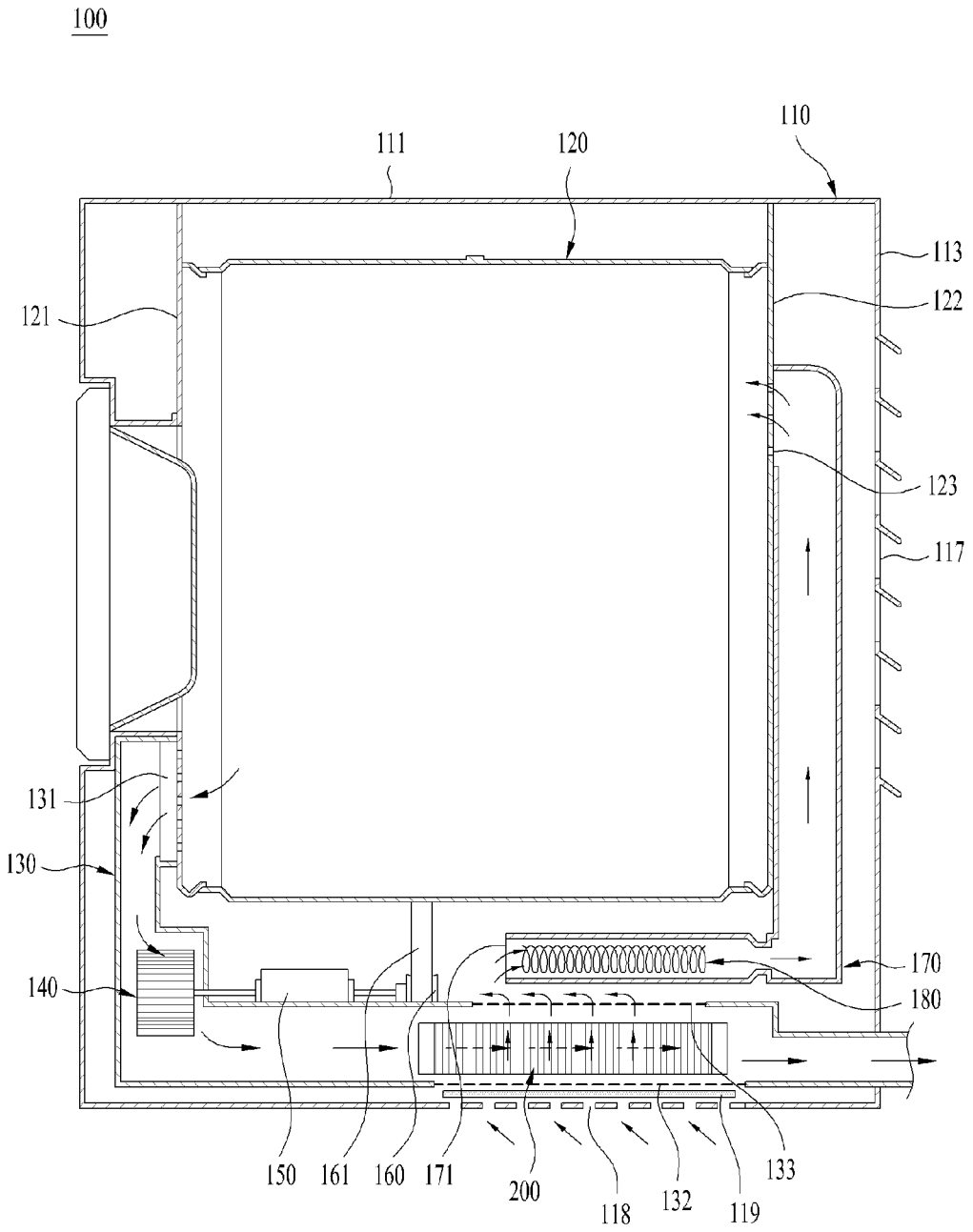
FIG. 8 is a side cross-sectional view illustrating the clothes dryer according to another embodiment of the present invention.

FIG. 7 is a perspective view illustrating a clothes dryer according to another embodiment of the present invention. FIG. 8 is a side cross-sectional view illustrating the clothes dryer of FIG. 7.

No description will be given of duplicated configurations of the above-mentioned clothes dryer.

The exhaust duct 130 of the clothes dryer according to another embodiment of the present invention may be equipped therein with a heat exchanger 200 installed to a rear end of the air blowing fan 140. The heat exchanger 200 recovers sensible heat of hot and humid air discharged out of the cabinet 110 after performing drying within the drum 120 by the air blowing fan 140.

The heat exchanger 200 is formed with passages in which air introduced through a bottom opening portion 118 formed on the base 114 of the cabinet 110 and hot and humid air discharged from the drum 120 may be divided and flow, so that a space in which heat exchange is performed between the respective flows may be formed in the heat exchanger 200.

Specifically, the heat exchanger 200 may be formed therein with a divided space in which air introduced from the inside or outside of the cabinet 110 and air discharged from the drum 120 respectively flow in a first flow direction and a second flow direction.

That is, heat exchange may be performed while the air introduced from the bottom opening portion 118 or the rear opening portion 117 passes through the heat exchanger 200 and flows in the first flow direction and the air discharged from the drum 120 flows in the second flow direction in the divided space provided within the heat exchanger 200.

In this case, the first and second flow directions of air flowing within the heat exchanger 200 may be defined so as to intersect with each other by a predetermined angle. In more detail, the first and second flow directions may be perpendicular to each other within the heat exchanger 200.

Meanwhile, an air introduction port 132 through which air is introduced from the outside of the exhaust duct 130 may be provided on a lower surface of the exhaust duct 130 which is formed to face the base 114 of the cabinet 110.

The air introduction port 132 is preferably formed to correspond to a position of the bottom opening portion 118 formed on the bottom of the cabinet 110, in order to reduce resistance of air introduced from the outside of the cabinet 110. Although the air introduction port 132 of the exhaust duct 130 may be formed in a size corresponding to an outer peripheral surface of the bottom opening portion 118 formed on the base 114 of the cabinet 110, the air introduction port 132 may also be formed in a size greater than that of the outer peripheral surface of the bottom opening portion 118.

In addition, a bottom filter 119, which filters out air introduced into the bottom opening portion 118, may be additionally provided between the bottom of the cabinet 110 and the air introduction port 132.

Air introduced into the air introduction port 132 may be air outside the cabinet 110, which is directly introduced through the bottom opening portion 118 formed on the bottom of the cabinet 110, and air flowing within the cabinet 110, which is introduced through the rear opening portion 117 formed on the rear cover 113 of the cabinet 110.

An air discharge port 133, through which air introduced from the air introduction port 132 is discharged, may be formed on an upper surface of the exhaust duct 130 which is formed to be spaced apart from the lower surface of the exhaust duct 130 in a height direction of the cabinet 110 by a predetermined distance.

The air discharge port 133 is preferably formed greater than an outer peripheral surface of a passage to which air introduced into the air introduction port 132 of the exhaust duct 130 passes through the heat exchanger 200 provided within the exhaust duct 130 and is then discharged.

That is, the first flow direction of air flowing in the divided space within the heat exchanger 200 may be a flow direction in which air is introduced into the air introduction port 12 of the exhaust duct 130 and is discharged to the air discharge port 133.

In addition, the second flow direction may be a flow direction in which air is discharged from the drum 120 and is discharged to the outside of the cabinet 110.

Meanwhile, air, which passes through the heat exchanger 200 and is discharged to the air discharge port 133 in the first flow direction, may be introduced into the intake duct 170.

In this case, air flowing in the first flow direction may exchange heat with heat radiated from the intake duct 170 while flowing along the outer peripheral surface of the intake duct 170.

That is, after air flowing in the first flow direction primarily exchanges heat with air flowing in the second flow direction while passing through the heat exchanger 200, the air may be preheated by secondarily exchanging heat with heat radiated from the intake duct 170 while flowing into the intake duct 170 and then be introduced into the intake duct 170.

Figure 9:
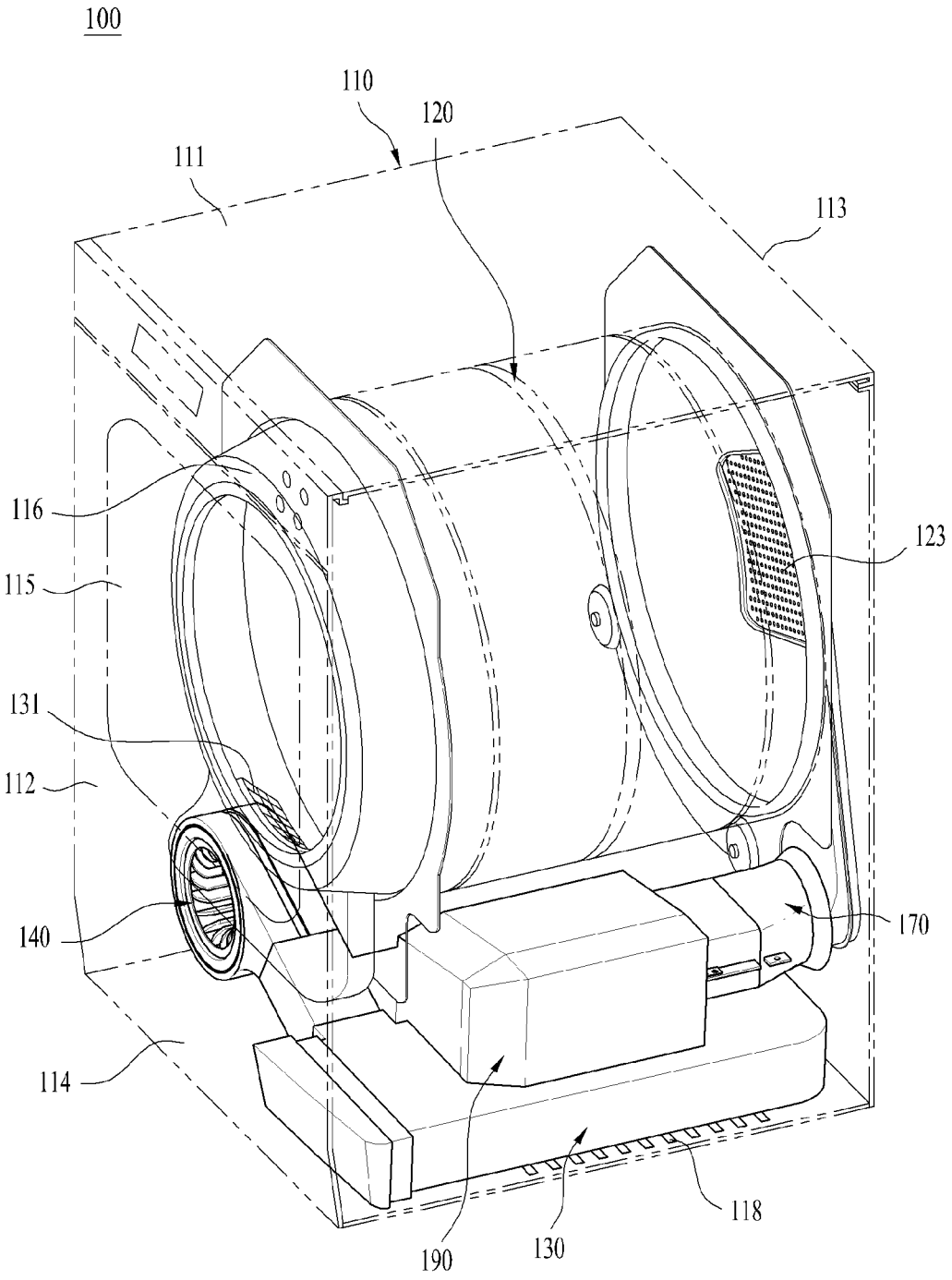
FIG. 9 is a perspective view illustrating a clothes dryer according to a further embodiment of the present invention.

Furthermore, in the clothes dryer according to another embodiment of the present invention, since the bottom opening portion 118 is formed on the base 114 of the cabinet 110 and air is directly introduced through the bottom opening portion 118, as shown in FIG. 9, the flow resistance of the air is decreased and thus a load of the motor 150 may be reduced.

Meanwhile, the clothes dryer according to another embodiment of the present invention may be further provided with a preheating member 190 installed to surround an intake duct 170 in order to reuse heat radiated out of the intake duct 170 and increase energy efficiency.

Hereinafter, a clothes dryer including a preheating member according to a further embodiment of the present invention will be described in detail with reference to FIGS. 9 to 12.

Figure 10:
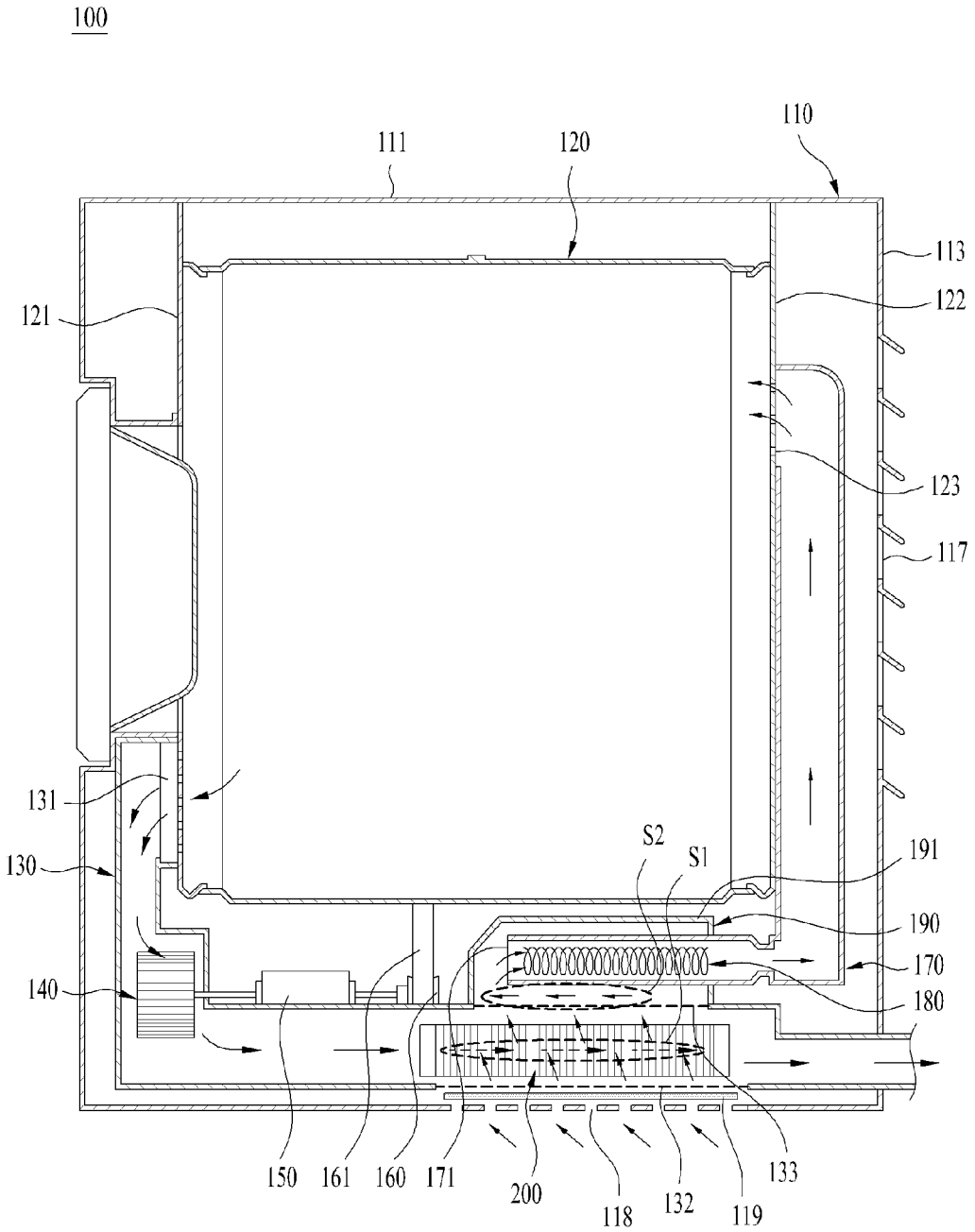
FIG. 10 is a side cross-sectional view illustrating the clothes dryer according to the further embodiment of the present invention.
Figure 11:
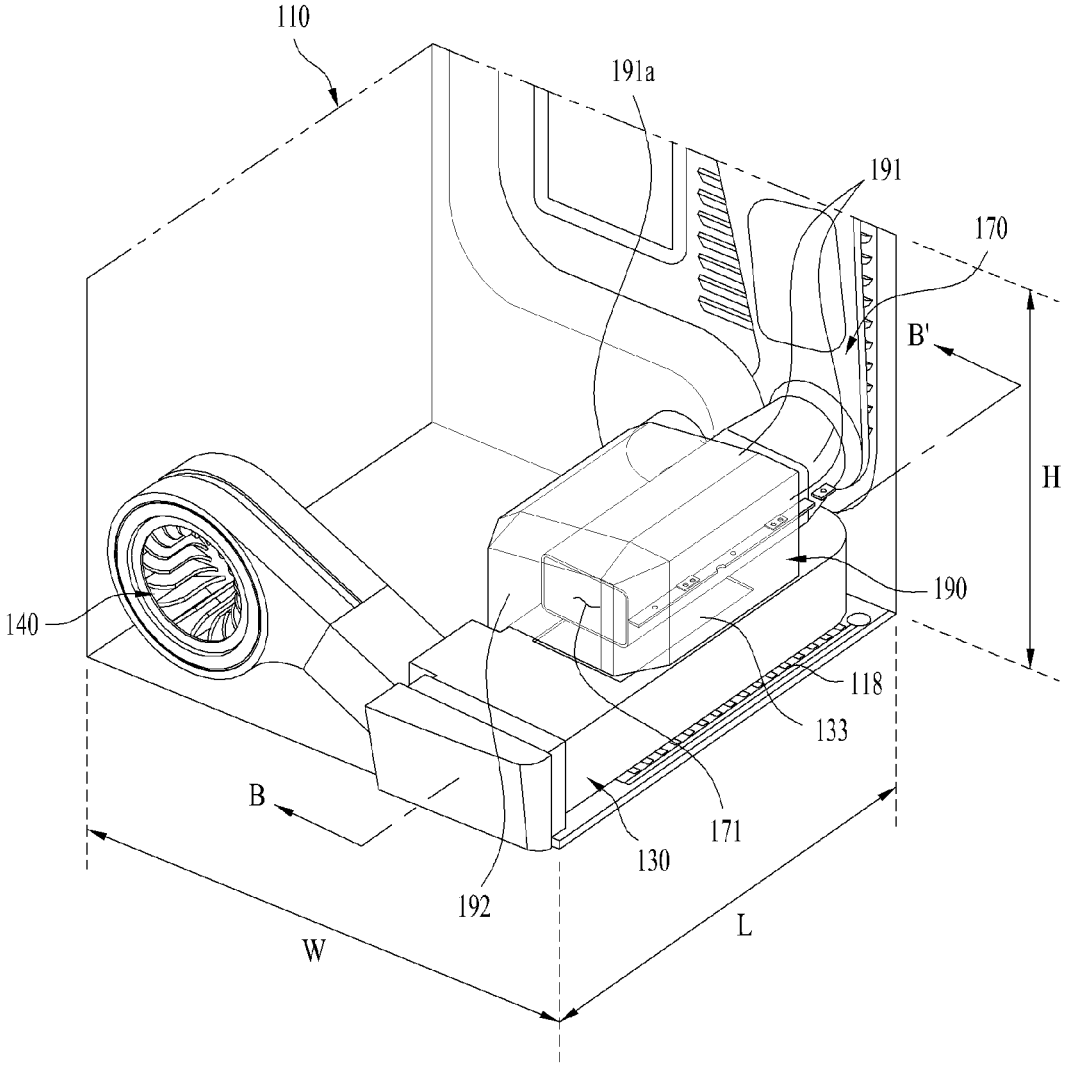
FIG. 11 is a perspective view illustrating an exhaust duct, a preheating member, and an intake duct according to the further embodiment of the present invention.
Figure 12:
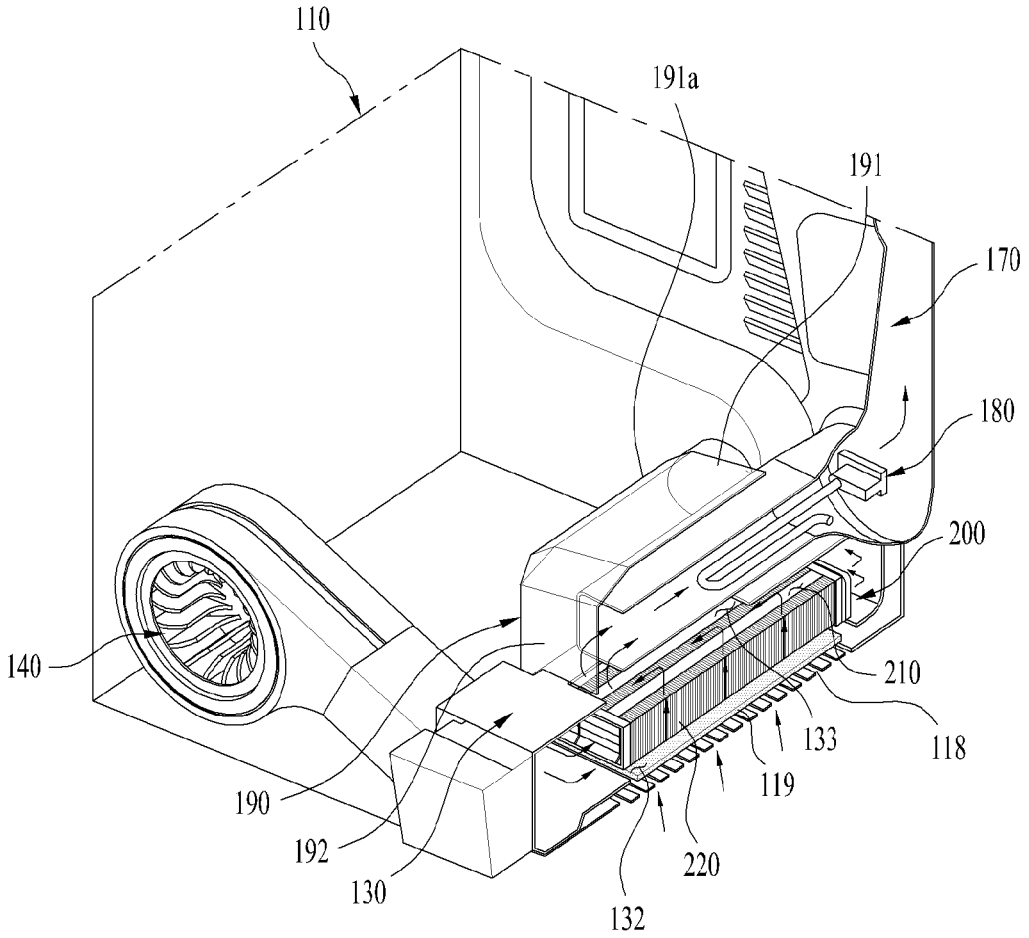
FIG. 12 is a cross-sectional view taken along line B-B' of FIG. 11.

FIG. 9 is a perspective view illustrating a clothes dryer according to a further embodiment of the present invention. FIG. 10 is a side cross-sectional view illustrating the clothes dryer of FIG. 9. FIG. 11 is a perspective view illustrating an exhaust duct, a preheating member, and an intake duct according to the further embodiment of the present invention. FIG. 12 is a longitudinal cross-sectional view taken along line B-B' of FIG. 11 and shows a flow of air introduced into the exhaust duct, the intake duct, and the preheating member.

No description will be given of duplicated configurations of the above-mentioned clothes dryer 100.

A clothes dryer 100 according to a further embodiment of the present invention may include a cabinet 110, a drum 120 provided within the cabinet 110 to provide a space for receiving laundry, an intake duct 170 forming a passage through which hot air is supplied to the drum 120, and a heating portion 180 for heating air introduced into the intake duct 170.

In addition, the clothes dryer 100 may include an exhaust duct 130 forming a passage through air is discharged from the drum 120.

The cabinet 110 may be formed therein with an exhaust passage through which air discharged from the drum is discharged out of the cabinet 110 through the exhaust duct 130, and an intake passage through which air inside or outside the cabinet 110 is guided to the drum 120.

The exhaust passage may be provided with a heat exchanger 200 in which air discharged to the exhaust passage exchanges heat with air introduced into the intake passage.

Meanwhile, the heat exchanger 200 may be formed therein with a divided space in which air flowing in the intake passage and air flowing in the exhaust passage respectively flow in a first flow direction and a second flow direction.

The first and second flow directions of air flowing in the divided space formed in the heat exchanger 200 may be defined so as to intersect with each other by a predetermined angle. In more detail, the first and second flow directions may be perpendicular to each other.

Meanwhile, the clothes dryer 100 may further include a preheating member 190 formed with a heat exchange space through which air passing through the heat exchanger 200 is guided to the intake duct 170 so that air flowing into the intake duct 170 via the heat exchanger 200 exchanges heat with heat radiated from the intake duct 170 in the heat exchange space.

The preheating member 190 may form a space in which air flowing in the preheating member 190 exchanges heat with heat radiated from the intake duct 170. Accordingly, it may be possible to increase energy efficiency of the dryer by reusing heat radiated through the intake duct 170 to preheat air flowing in the preheating member 190.

The preheating member 190 may be fixed to the upper side of the exhaust duct 130. Accordingly, air introduced into the air introduction port 132 formed on the lower surface of the exhaust duct 130 may pass through the heat exchanger 200 and then be discharged to the air discharge port 133 formed on the upper surface of the exhaust duct 130 to be introduced into the preheating member 190.

Hereinafter, the exhaust duct, the intake duct, the preheating member, and the flow of air will be described in more detail.

As described above, the inside of the cabinet 100 may be formed with an exhaust passage through which air discharged from the drum 120 is discharged out of the cabinet 110 through the exhaust duct 130, and an intake passage through which air inside or outside the cabinet 110 is guided to the drum 120.

The intake passage is a passage through which air is introduced and preheated, and is then heated to flow into the drum in order to generate hot air for drying, and may be specifically configured as follows.

The intake passage may include an air introduction passage through which air introduced through the bottom opening portion 118 is introduced into the air induction port 132 formed on the lower surface of the exhaust duct 130 or air introduced into the rear opening portion 117 flows within the cabinet 110 to be introduced into the air introduction port 132.

The intake passage may include a plurality of first heat exchange passages formed at a rear end of the air induction passage within the heat exchanger 200 such that air introduced into the exhaust duct 130 exchanges heat with air discharged from the drum 120 while flowing in the first heat exchange passages.

The intake passage may include a second heat exchange passage formed at rear ends of the first heat exchange passages such that air passing through the heat exchanger 200 is guided to the preheating member 190 located at the upper side of the exhaust duct 130, and exchanges heat with heat radiated from the preheating member 190, and is then guided to the intake duct 170 through the second heat exchange passage.

The intake passage may include a hot air moving passage through which air guided to the intake duct 170 through the second heat exchange passage flows within the intake duct 170 such that air introduced into the intake duct 170 is hot air while passing through the heating portion 180 and thus the hot air is guided to the drum 120 through the hot air moving passage.

Accordingly, the intake passage is configured by the air introduction passage, the first heat exchange passages, the second heat exchange passage, and the hot air moving passage, and air introduced into the intake passage may sequentially pass through the passages so as to be guided to the drum 120.

Meanwhile, the exhaust passage is a passage through which hot air performing drying in the drum 120 is discharged out of the cabinet 110, and may be specifically configured as follows.

The exhaust passage may include a first exhaust passage formed within the exhaust duct 130 such that hot and humid air discharged from the drum 120 flows in the first exhaust passage.

The exhaust passage may include a plurality of heat radiation passages formed at a rear end of the first exhaust passage within the heat exchanger 200 such that hot and humid air discharged from the drum 120 is deprived of heat by heat exchange with air flowing in the intake passage formed within the heat exchanger 200 while flowing in the heat radiation passages.

In this case, the heat exchanger 200 may be alternately formed with the first heat exchange passages of the intake passage and the heat radiation passages of the exhaust passage, thereby increasing heat exchange efficiency.

In addition, a first flow direction of air flowing in the intake passage formed in the heat exchanger 200 and a second flow direction of air flowing in the exhaust passage may be defined to intersect with each other while forming a predetermined angle with each other. As a result, a heat exchange area between the first and second flow directions may be increased so that heat exchange is rapidly performed.

The exhaust passage may include a second exhaust passage formed at rear ends of the heat radiation passages such that air having a low temperature by being deprived of heat during passing through the heat radiation passages is discharged out of the cabinet 110 through the second exhaust passage.

Accordingly, the exhaust passage is configured by the first exhaust passage, the heat radiation passages, and the second exhaust passage, and air discharged to the exhaust passage may sequentially pass through the passages so as to be discharged out of the cabinet 110.

Meanwhile, in more detail, the preheating member 190 may include a preheating portion 191 which is spaced apart from the intake duct 170 by a predetermined distance and surrounds the intake duct 170, and a flow switching portion 192 which guides air passing through the preheating portion 191 to the air inlet 171 of the intake duct 170.

The preheating portion 191 may be shaped to surround the intake duct 170 in order to form a flow space in which air passing through the heat exchanger 200 may flow along the outer peripheral surface of the intake duct 170.

In this case, the preheating portion 191 may be formed with a heat exchange space in which heat exchange is performed by heat radiated from the intake duct 170. Air flowing in the preheating portion 191 may flow in the heat exchange space and heat lost out of the intake duct 170 may be recovered and preheated.

The preheating portion 191 may extend from an end thereof formed with the air inlet 171 in a longitudinal direction L of the side of the cabinet 110 by a predetermined length so as to extend to a position of the heating portion 180. This enables the preheating portion 191 to surround the entirety of the heating portion 180, and thus the heat exchange space for preheating air flowing in the preheating portion 191 may be more effectively formed.

The preheating portion 191 may be formed, at a lower surface thereof, with an opening portion which has a shape and a size corresponding to the air discharge port 133 of the exhaust duct 130 or the lower surface of the preheating portion 191 may be formed to be wholly opened, so that air passing through the heat exchanger 200 is introduced therethrough.

Meanwhile, the flow switching portion 192 of the preheating member 190 may serve to switch an air flow direction such that air passing through the preheating portion 191 is introduced into the air inlet 171 of the intake duct 170.

The flow switching portion 192 may be spaced apart from the air inlet 171 in the front thereof by a predetermined distance and be formed to face the air inlet 171.

Although the preheating portion 191 and the flow switching portion 192 may be formed to be separated from each other, the preheating portion 191 and the flow switching portion 192 are preferably formed integrally with each other in order to prevent diffusion of heat energy radiated out of the intake duct 170.

In order to decrease flow resistance of air when the air flow direction is switched from the preheating portion 191 to the flow switching portion 192, a connection part at which the preheating portion 191 is connected to the flow switching portion 192 may be obliquely formed or be formed to have a curvature.

Accordingly, the preheating member 190 may have a hollow cylindrical shape or a polyhedral shape, which is opened at one surface thereof.

Figure 13:
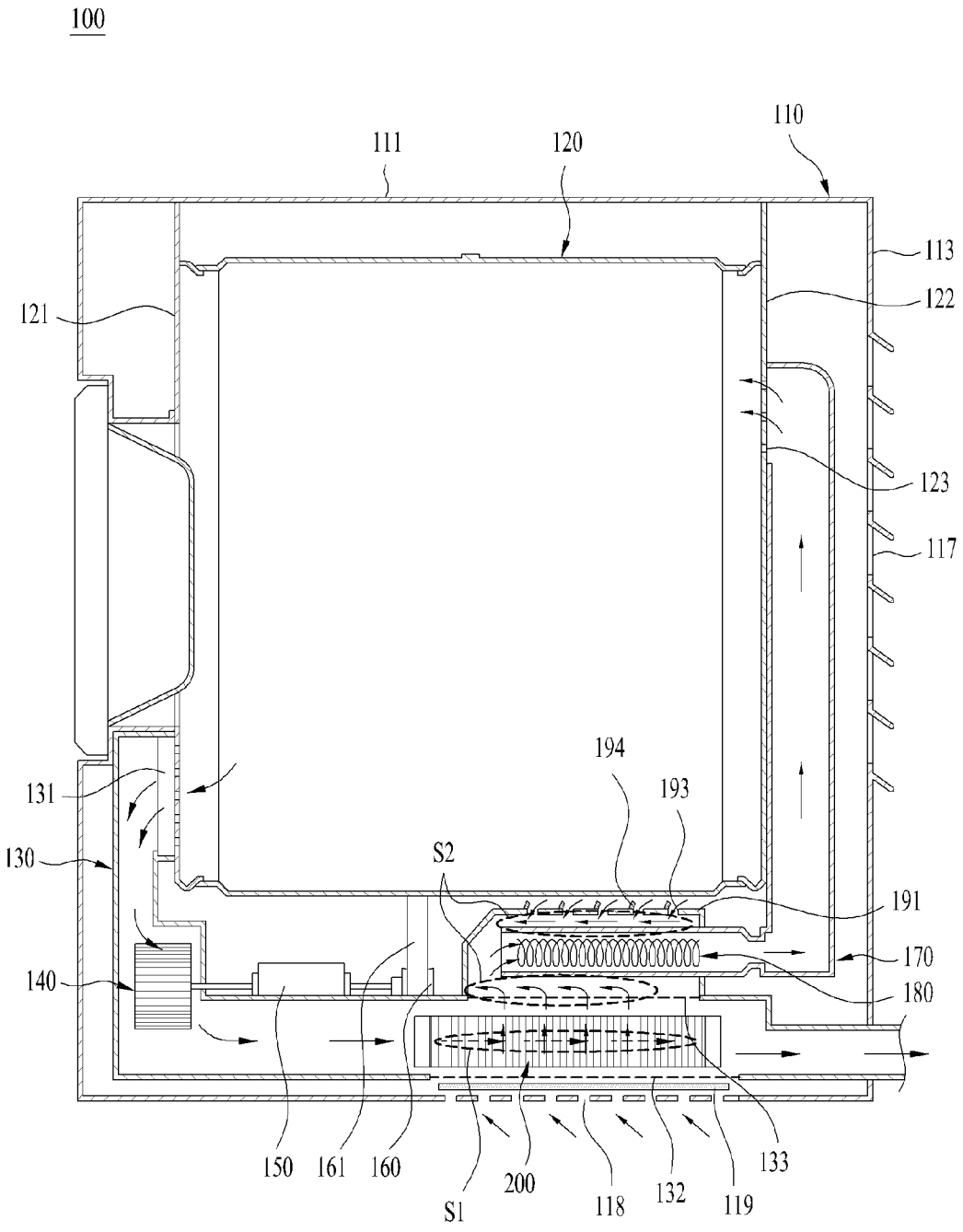
FIG. 13 is a side cross-sectional view illustrating a clothes dryer according to a modified example of the further embodiment of the present invention.

Hereinafter, a modified example of the preheating member will be described in detail with reference to FIG. 13. FIG. 13 is a side cross-sectional view illustrating a clothes dryer according to a modified example of the further embodiment of the present invention.

As shown in FIG. 13, the preheating portion 191 of the preheating member 190 may be formed with one or more air introduction holes 193 through which air introduced into the rear opening portion 117 of the cabinet 110 is guided into the preheating member 190.

Each of the air introduction holes 193 may be formed in a direction parallel with or perpendicular to the flow direction of air flowing in the preheating portion 191.

The air introduced into the rear opening portion 117 of the cabinet 110 may be introduced into the air introduction holes 193 in a state of being preheated by absorbing heat emitted to the outer peripheral surface of the drum 120 during the drying process while flowing within the cabinet 110.

Accordingly, at least one surface of the preheating portion 191 formed with the one or more air introduction holes 193 may be provided adjacent to the outer peripheral surface of the drum 120.

That is, at least one surface of the preheating member 190 is preferably provided adjacent to the drum 120 such that air heated by heat emitted from the drum 120 is easily introduced into the preheating portion 191.

In this case, a drum adjacent portion 191*a* of the preheating portion 191 provided adjacent to the drum 120 may be installed to be spaced apart from the drum 120 by a predetermined distance.

That is, the drum adjacent portion 191*a* is preferably spaced apart from the drum 120 by a minimum distance so as not to interfere with rotation of the drum 120.

In addition, the drum adjacent portion 191*a* may be curved so as to have the same radius of curvature as the drum 120 so as to face the peripheral surface of the drum 120.

Meanwhile, the preheating portion 191 may be provided, at an outer surface thereof, with at least one air guide 194 for guiding air such that the air is easily introduced into the one or more air introduction holes 193.

This enables the flow resistance and flow loss of air introduced into the preheating member 190 to be reduced.

The air guide 194 may be formed in a circular arc shape opened upward of each of the air introduction holes 193 such that one side of the air guide 194 is fixed at a position adjacent to the air introduction hole 193 on the outer surface of the preheating portion 191 and the other side thereof has a certain angle.

In this case, the air guide 194 is preferably formed at each of the one or more air introduction holes 193.

In accordance with the above-mentioned configuration, the air introduced into the rear opening portion 117 of the cabinet 110 may be introduced into the plural air introduction holes 193 in a state of being preheated by absorbing heat emitted to the outer peripheral surface of the drum 120.

The air introduced into the preheating member 190 through the air introduction holes 193 may be further preheated by exchanging heat with heat emitted from the intake duct 170 while flowing in the heat exchange space formed in the preheating member 190, and then be introduced into the intake duct 170 by switching the flow direction of the air at the flow switching portion 192.

Hereinafter, a process in which heat exchange is performed in the exhaust duct, the intake duct, and the preheating member of the present invention will be described in more detail with reference to FIGS. 10 and 13.

The inside of the exhaust duct 130 may be provided with the air blowing fan 140 for discharging air within the drum 120, and the heat exchanger 200 including a first heat exchange space S1 in which air introduced from the outside of the cabinet 110 to the inside of the exhaust duct 130 exchanges heat with sensible heat of air discharged from the drum 120.

The preheating member 190 may include a second heat exchange space S2 through which air passing through the heat exchanger 200 is guided to the intake duct 170 and in which air introduced into the intake duct 170 via the heat exchanger 200 exchanges heat with heat radiated from the intake duct 170 while flowing in the preheating member 190.

Air introduced from the bottom of the cabinet 110 may be primarily preheated while flowing in the first heat exchange space S1 and be secondarily preheated while flowing in the second heat exchange space S2, so as to be introduced into the air inlet 171 of the intake duct 170.

Figure 14:
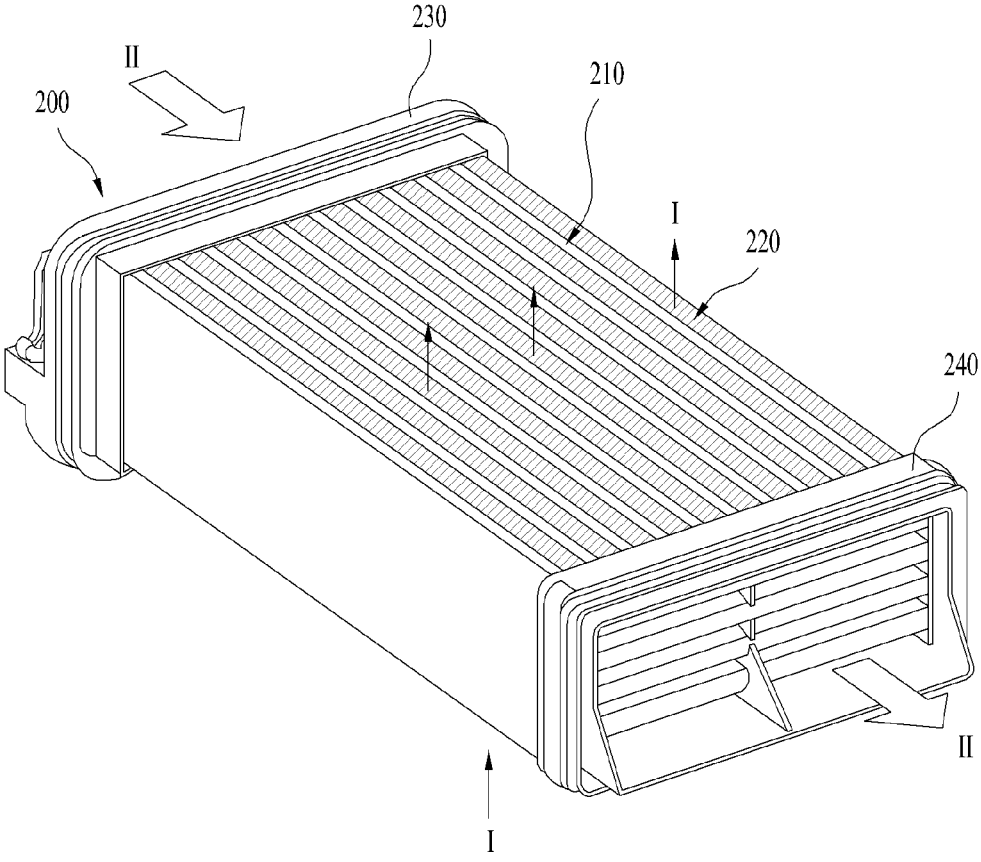
FIG. 14 is a perspective view illustrating a heat exchanger according to the present invention.

Hereinafter, the heat exchanger of the present invention will be described in more detail with reference to FIG. 14. FIG. 14 is a perspective view illustrating the heat exchanger 200 according to the present invention.

Meanwhile, the heat exchanger 200 may be formed with a plurality of passages for heat exchange in which air introduced through the bottom opening portion 118 formed on the base 114 of the cabinet 110 and hot and humid air discharged from the drum 120 are divided and flow.

That is, a first flow direction I of air flowing toward the intake duct 170 from the bottom of the cabinet 110 and a second flow direction II of air discharged from the drum 120 may be defined in the heat exchanger 200.

As shown in FIG. 14, the heat exchanger 200 according to the embodiment of the present invention may be formed by alternately stacking a plurality of tubes 210 and fin structures 220. The heat exchanger 200 may further include a front cap 230 which surrounds a front end thereof and a rear cap 240 which surrounds a rear end thereof.

Each of the tubes 210 is opened at both ends thereof and is configured as a duct structure having a rectangular cross-section. The tube 210 may form a passage in which air discharged from the drum 120 flows in the second flow direction II.

In addition, each of the fin structures 220 may form a passage configured by bending a metal plate in a zigzag form such that air may flow in the passage. The fin structure 220 may be formed by bending a metal plate so as to have a corrugated shape. For example, the fin structure 220 may be formed such that a rectangular cross-section thereof is continuously configured in a longitudinal direction L, or may also be formed such that a triangular cross-section thereof is continuously configured.

Accordingly, the fin structure 220 may form a passage in which air introduced from the bottom of the cabinet 110 flows in the first flow direction I by the above corrugated shape.

The tubes 210 and the fin structures 220 form one heat exchanger 200 by repeatedly stacking respective layers thereof having thin thicknesses. Due to such a repeated stacking structure, it may be possible to increase heat exchange efficiency in the first and second flow directions I and II.

As shown in FIG. 12, the tubes 210 and the fin structures 220 may be stacked in a width direction W of the exhaust duct 130.

The second flow direction II may be defined such that air discharged from the drum 120 flows in the tubes 210 in the longitudinal direction L of the exhaust duct 130, and the first flow direction I may be defined such that air introduced from the bottom of the cabinet 110 flows in the fin structures 220 in a height direction H of the exhaust duct 130.

In this case, the first flow direction I and the second flow direction II may be defined to vertically intersect with each other or may also be defined to intersect with each other while forming a predetermined angle with each other. Consequently, a contact area in which heat transfer is generated between the first flow direction I and the second flow direction II may be enlarged, thereby enhancing heat exchange efficiency.

An operation process of the clothes dryer according to the embodiment of the present invention will be schematically described again with reference to FIGS. 7 to 13.

In the process of drying laundry according to the present invention, air introduced through the bottom opening portion 118 formed on the bottom of the cabinet 110 passes through the heat exchanger 200 provided within the exhaust duct 130 through the air introduction port 132 formed on the lower surface of the exhaust duct 130.

The heat exchanger 200 is formed by stacking the tubes 210 and the fin structures 220, heat exchange is generated between the tubes 210 in which hot air discharged from the drum 120 flows and the fin structures 220 in which air introduced from the bottom of the cabinet 110 flows.

In this case, air flowing in the fin structures 220 may be primarily preheated by absorbing sensible heat radiated from air flowing in the tubes 210.

The air, which is primarily preheated during passing through the heat exchanger 200, may be discharged through the air discharge port 133 of the exhaust duct 130, and then be introduced into the intake duct 170 provided with the preheating portion 180 therein.

The preheating member 190, which is spaced apart from the intake duct 170 by a predetermined distance to surround the intake duct 170, may be further provided so as to improve heat exchange efficiency with heat radiated from the intake duct 170.

In another embodiment, air introduced through the rear opening portion 117 formed on the rear surface of the cabinet 110 may be introduced into the preheating member 190 through the air introduction holes 193 formed on the preheating member 190.

In this case, the air introduced through the rear opening portion 117 may be primarily preheated by absorbing heat radiated to the outer peripheral surface of the drum 120 during the drying process in the drum 120, and then be introduced into the preheating member 190.

Meanwhile, air introduced into the preheating member 190 may be secondarily preheated by additionally absorbing heat energy which is radiated from the heating portion 180 installed in the intake duct 170 to the outer surface of the intake duct 170 while passing through the preheating portion 191 of the preheating member 190.

The air passing through the preheating portion 191 is introduced into the air inlet 171 of the intake duct 170 by the flow switching portion 192.

The air introduced into the air inlet 171 is hot air having a high temperature while passing through the heating portion 180 installed within the intake duct 170, so that the hot air is supplied to the drum 120.

In this case, since the air passing through the heating portion 180 is in a sufficiently preheated state, a heating time required to generate hot air having a high temperature is significantly shortened.

It may be possible to reduce an amount of energy consumption required to drive devices for generation of hot air and to thus provide the clothes dryer having increased energy efficiency.

Meanwhile, the drum 120 is rotated by driving of the motor 150, and an object to be dried comes into contact with the supplied hot air while being repeatedly tumbled in the drum 120, so as to be dried.

Hot and humid air within the drum 120 is discharged out of the cabinet 110 after performing a heat exchange process in the heat exchanger 200 while passing through the exhaust duct 130 by the air blowing fan 140.

In this case, since the air after performing the heat exchange process in the heat exchanger 200 is discharged out of the cabinet 110 in a state of having a low temperature, it may be possible to improve safety of the clothes dryer.

Various embodiments have been described in the best mode for carrying out the invention.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A clothes dryer comprising:

a cabinet;

a drum provided within the cabinet to provide a space for receiving laundry;

an intake duct extending from the drum, the intake duct having an air inlet for introducing air into the drum at a free end of the intake duct;

a heater provided in the intake duct to heat air introduced into the intake duct;

an exhaust duct through which air is discharged from the drum; and a preheater having an opened end and receiving the air inlet;

wherein the preheater further comprises:

an end wall provided to be opposed to the opened end and configured to be spaced apart from a front of the air inlet; and a side wall surrounding an outer circumference of the intake duct and extending in a lengthwise direction from the end wall to the opened end along a region of the intake duct including the air inlet and a region where the heater is disposed in the intake duct, and wherein the side wall further includes a plurality of air introduction holes, the plurality of air introduction holes penetrating through the side wall.

2. The clothes dryer according to claim 1, wherein the side wall is spaced apart from the outer circumference of the intake duct.

3. The clothes dryer according to claim 2, wherein the side wall and the end wall are formed integrally with each other.

4. The clothes dryer according to claim 1, wherein the side wall is spaced apart from the drum to prevent interference with rotation of the drum, and wherein the side wall is curved to have the same radius of curvature as an outer peripheral surface of the drum.

5. The clothes dryer according to claim 1, wherein the plurality of air introduction holes are spaced apart from each other along the lengthwise direction of the side wall.

6. The clothes dryer according to claim 1, wherein the preheater further includes a plurality of air guides extending outwardly from an exterior surface of the side wall to guide air to the plurality of air introduction holes.

7. The clothes dryer according to claim 6, wherein each of the plurality of air guides extends from a first end connected to the side wall to a second end spaced above the exterior surface of the side wall, and wherein each of the plurality of air guides is angled so that the second end extends in a direction toward the opened end of the preheater.

8. The clothes dryer according to claim 6, wherein each of the plurality of air guides extends in a curved shape between a first end connected to the side wall and a second end spaced above the exterior surface of the side wall.

* * * * *